US007812233B1

(12) United States Patent
Lee

(10) Patent No.: US 7,812,233 B1
(45) Date of Patent: Oct. 12, 2010

(54) CHORD AIDING DEVICE FOR A FRETTED STRINGED INSTRUMENT

(76) Inventor: Steven Pyoung-Uk Lee, 2823 Versante Terrace La., Chino Hills, CA (US) 91709

( * ) Notice: Subject to any disclaimer, the term of this patent is extended or adjusted under 35 U.S.C. 154(b) by 0 days.

(21) Appl. No.: 12/077,714

(22) Filed: Mar. 20, 2008

(51) Int. Cl.
*G10H 3/00* (2006.01)

(52) U.S. Cl. ..... 84/317; 84/646; 84/722

(58) Field of Classification Search ..... 84/615, 84/637, 646, 669, 722, 317, 315, 319, 7–12
See application file for complete search history.

(56) References Cited

U.S. PATENT DOCUMENTS

| | | | | | |
|---|---|---|---|---|---|
| 627,410 | A | * | 6/1899 | Graus | 84/317 |
| 1,437,026 | A | * | 11/1922 | Spartivento | 84/317 |
| 1,635,542 | A | * | 7/1927 | Conner | 84/317 |
| 1,687,849 | A | * | 10/1928 | Schmidt | 84/317 |
| 1,692,560 | A | * | 11/1928 | Mokrejs | 84/317 |
| 1,853,999 | A | * | 4/1932 | Solenberger | 84/317 |
| 1,871,021 | A | * | 8/1932 | Zachrison | 84/8 |
| 2,132,281 | A | * | 10/1938 | Adamson | 84/317 |
| 2,669,151 | A | * | 2/1954 | Maccaferri | 84/317 |
| 2,744,433 | A | * | 5/1956 | Rooms | 84/315 |
| 2,798,398 | A | * | 7/1957 | Hayes | 84/317 |
| 3,422,717 | A | * | 1/1969 | Roussel | 84/317 |
| 3,446,108 | A | * | 5/1969 | Mitchell, Jr. | 84/317 |
| 3,568,560 | A | * | 3/1971 | Chang et al. | 84/317 |
| 3,682,036 | A | * | 8/1972 | Null et al. | 84/317 |
| 3,758,698 | A | * | 9/1973 | Matyas | 84/485 R |
| 3,837,255 | A | * | 9/1974 | Starns et al. | 84/317 |
| 3,915,051 | A | * | 10/1975 | Kincaid | 84/317 |
| 4,030,400 | A | * | 6/1977 | Del Castillo | 84/317 |
| 4,037,503 | A | * | 7/1977 | Jacobson et al. | 84/9 |
| 4,154,134 | A | * | 5/1979 | Schreiber | 84/317 |
| 4,228,718 | A | * | 10/1980 | Smith | 84/317 |
| 4,249,450 | A | * | 2/1981 | Quemore, Sr. | 84/317 |
| 4,289,057 | A | * | 9/1981 | Whitlock | 84/485 SR |
| 4,331,059 | A | * | 5/1982 | Marabotto | 84/317 |
| 4,545,281 | A | * | 10/1985 | Habicht | 84/315 |
| 4,545,282 | A | * | 10/1985 | Arnett et al. | 84/317 |
| 4,566,365 | A | * | 1/1986 | Huston, Jr. | 84/317 |
| 4,615,253 | A | * | 10/1986 | McGovern | 84/317 |

(Continued)

*Primary Examiner*—David S. Warren

(57) ABSTRACT

An aiding device, "E-Z Master Chord", for playing fretted string instruments, such as an acoustic guitar played by a beginner, is provided. The aiding device according to the current application is engaged over frets of an acoustic guitar to generate a chord with only two fingers of a player. The aiding device is comprised of: including but not limited to; 12 two position key pads installed on the key pad box; 7 single position key pads installed on the key pad box; a strap harness that engages the key box to fret portion of a guitar; an electronic circuit board installed inside of the keyboard box just below the key pad; a memory device installed inside the keyboard box just above the circuit board; a plurality of electromagnetic actuators installed inside of the key pad box just below the circuit board; a metal spring installed inside of the key pad box just below the electromagnetic actuators; a plurality of pressing pins installed inside of the keyboard box just below the metal spring and over strings of the guitar; a rechargeable battery installed inside of the key pad box, each key in the set of 12 keys can play two kinds of chord for creating 'major' and 'minor' sonorities; where, Each key in the set of 7 keys has a specific function to add one or two extra tones for chord 'inversions', '7', '9', 'augmented', and 'diminished' sonorities.

3 Claims, 8 Drawing Sheets

U.S. PATENT DOCUMENTS 4,622,880 A * 11/1986 Glemming et al. ..... 84/317
4,665,789 A * 5/1987 Papadatos ..... 84/317
4,748,890 A * 6/1988 Tutaj ..... 84/485 SR
5,831,189 A * 11/1998 Edlund ..... 84/315
6,166,307 A * 12/2000 Caulkins et al. ..... 84/50
6,753,466 B1 * 6/2004 Lee ..... 84/669
7,285,709 B2 * 10/2007 White et al. ..... 84/321
7,285,716 B2 * 10/2007 Gilmore et al. ..... 84/739
7,307,203 B2 * 12/2007 Buffkin et al. ..... 84/286
2005/0172779 A1 * 8/2005 Gilmore et al. ..... 84/8

* cited by examiner

CHORD AIDING DEVICE FOR A FRETTED STRINGED INSTRUMENT

FIELD OF THE INVENTION

Current application relates to an aiding device for playing fretted analog string musical instruments, especially fitted to an acoustic guitar used to provide the ability to play an instrument with little or no ability or proficiency.

BACKGROUND OF THE INVENTION

Playing good music with stringed musical instrument is a longing for most youngsters or persons with an inability to command an instrument. The guitar is an easily accessible musical instrument for youngsters because of its affordable price; however, learning and understanding mechanics necessary to produce chords on a guitar is not easy, although it is essential for the players to be successful. Mastering the many types of fingerings for producing chords and their relation to one another is essential, and requires mastery in order to inspire creativity. Many musical theory books demonstrate and refer to a vast array of chords. However, producing these chords in order to hear them in relation to each other is essential for musical development. Some aiding devices for easily playing chords on the guitar are available. Yet, they are cumbersome, complex, and unclear. The prior art has shown that there is not a device of simple and small, easy to use and compact, with a capability to construct any form or type of chord in music. Needed, is a better method that makes a stronger impact on the mind of the beginning player in which learning is quicker and enjoyable. Notations must be looked into again and again to absorb everything contained within the black and white pages. It is the purpose of the current application to provide an aiding device for chord generation, which has an ability to make a stronger impression if done in a clear simple manner. It is another purpose of the current application to provide an aiding instrument for a guitar player, who accidentally loses some of his/her fingers or is unable to command a fretted stringed instrument.

DESCRIPTION OF THE PRIOR ART

U.S. Pat. No. 4,748,890 to Tutaj illustrates musical teaching aid devices for fretted instruments such as guitar. The top side of the device contains indicia representing the names of the musical notes which are viewed through the top perforated piece, and the back side of the bottom piece contains the chord spelling of a plurality of chord types. In between both the top and bottom piece plates is a frame, which fastens the top and bottom together and serves the purpose of allowing slides to pass through the six given spaces (inserts) in the frame. One slide is given for each string, in which one perforation is centered in the middle of the slide to allow for the selection of a desired note when pushed or pulled through the embodiment.

U.S. Pat. No. 4,566,365 to Huston, Jr. illustrates a device for playing chords on a musical instrument by depressing a single pushbutton. The device is characterized by an L shaped base having a shorter leg which engages a side of the neck of the musical instrument and a longer leg which overlies the strings of the instrument. A number of spacers are provided to maintain separation in-between the base and the strings, and a pair of straps encircle the neck to hold the base in position. Three pushbutton assemblies are provided, each of which depresses three strings on a musical instrument.

U.S. Pat. No. 4,289,057 to Whitlock illustrates an apparatus for composing and indicating finger pattern information for a musical stringed fingerboard instrument comprising a plurality of align ably repositionable first series of first indicia, each first series representing at least one course of said stringed fingerboard instrument, the locations of said first indicia forming a mapping image of allowable locations for fingering the respective courses of the stringed fingerboard instrument to sound musical tones.

U.S. Pat. No. 4,249,450 to Quemore, Sr. illustrates a guitar having four strings, two frets and an attachment pivotally mounted between the frets whereby the three principal chords of any key to which it has been tuned may be obtained clearly.

U.S. Pat. No. 4,154,134 to Schreiber illustrates a chord playing attachment for stringed instruments, wherein combinations of string depressors are pressed down on the strings to produce a chord. The string depressors are connected with a spring action to a component which is attached to the instrument.

U.S. Pat. No. 3,758,698 to Matyas illustrates a 248/229 slide rule that simulates the finger board of fretted instruments is provided. The slide rule includes a housing having a plurality of longitudinally extending channels or guide ways each of which is adapted to receiving an axially displaceable slide, one for each string of the instrument.

U.S. Pat. No. 3,568,560 to Chang, et al. illustrates an apparatus for playing chords on a guitar which enables a rapid change between chord positions, including the major, minor, and dominant seventh chords of two keys separated by five half-tones. The apparatus comprises a chording device with levers for changing between the major, minor and dominant seventh chords of one key. The chording device is shift able laterally, and it includes cams which alter the positions at which the guitar strings are depressed when a lateral shift occurs to establish the corresponding chord in the other key.

None of the prior arts illustrates an aiding instrument that can press so many different chords with just one finger for general chord or two fingers for a complex chord.

SUMMARY OF THE INVENTION

Playing good music with stringed musical instrument is a longing for most youngsters. The guitar is one of the easily accessible musical instruments for youngsters because of affordable price; however, learning and understanding of chords of a guitar is not easy although it is essential for the players to be successful. Mastering many types of chords and their relation to one another is essential for creativity too. Some aiding devices for easy playing of the chords of guitar are available. However, they are cumbersome, complex, and unclear.

There is not a device of simple and small, easy to use and compact with the capability to construct any form or type of chord in music. It is the purpose of the current application to provide an aiding device for chord generation, which has an ability to make a stronger impression if done in a clear simple manner. It is another purpose of the current application to provide an aiding instrument for a guitar player who accidentally loses some of her fingers. An aiding device for playing fretted string instruments, such as analog guitar played by a beginner, is provided.

The aiding device according to the current application is engaged over fret portion of an acoustic guitar to generate a chord with only two fingers of a player. The aiding device is comprised of: 12 key pads installed on a key pad box; a hook that enables the key box engaging to fret portion of a guitar; a plurality of single position key pads located on player's side of the key pad box; an electronic circuit board installed inside of the keyboard box just below the key pad; pluralities of electromagnetic actuators installed inside of the key pad box just below the circuit board; pluralities of pressing pins installed inside of the keyboard box just below the return key pad and over strings of the guitar; and, a rechargeable battery inside of the key box. Each key can play two tones of 'major' and 'minor'.

A plurality of single position key pads along the key pad box and which when pressed play '6', '7' and '9' combined with chords of 'A' to 'G'.

DETAILED DESCRIPTION OF THE PREFERRED EMBODIMENT

Figure 1:
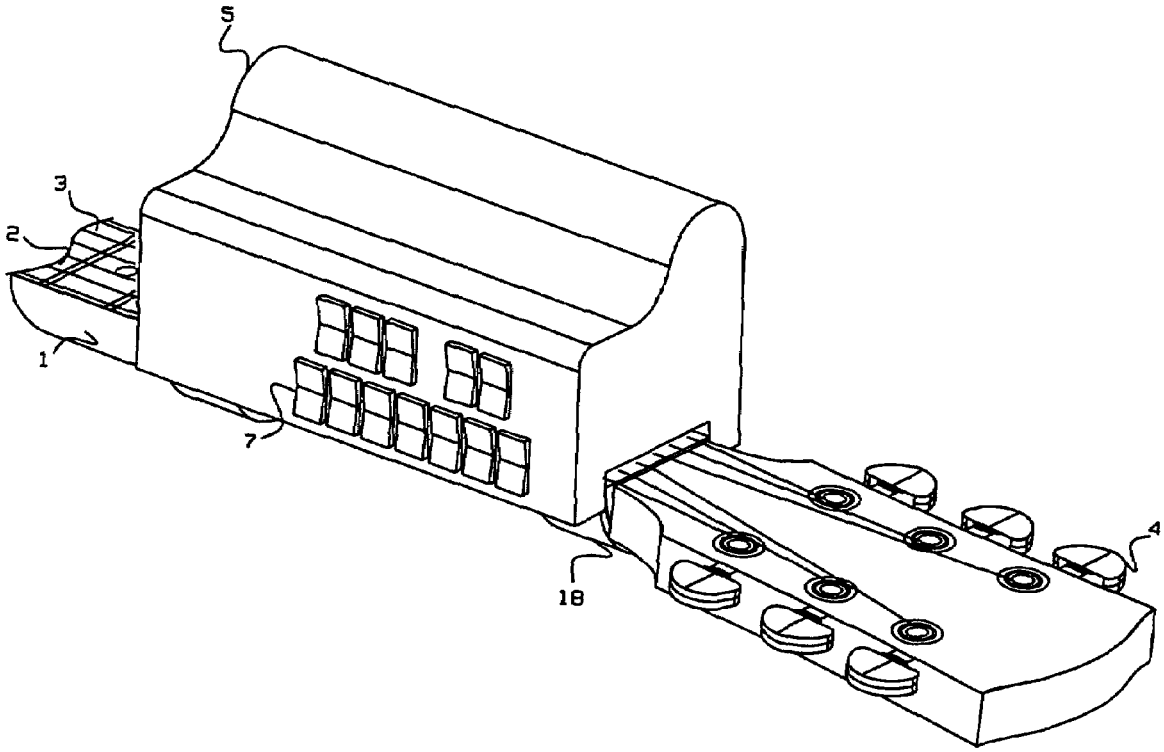
FIG. 1 is a perspective view of an 'E-Z Master Chord' device according to current application mounted on an acoustic guitar.
Figure 2:
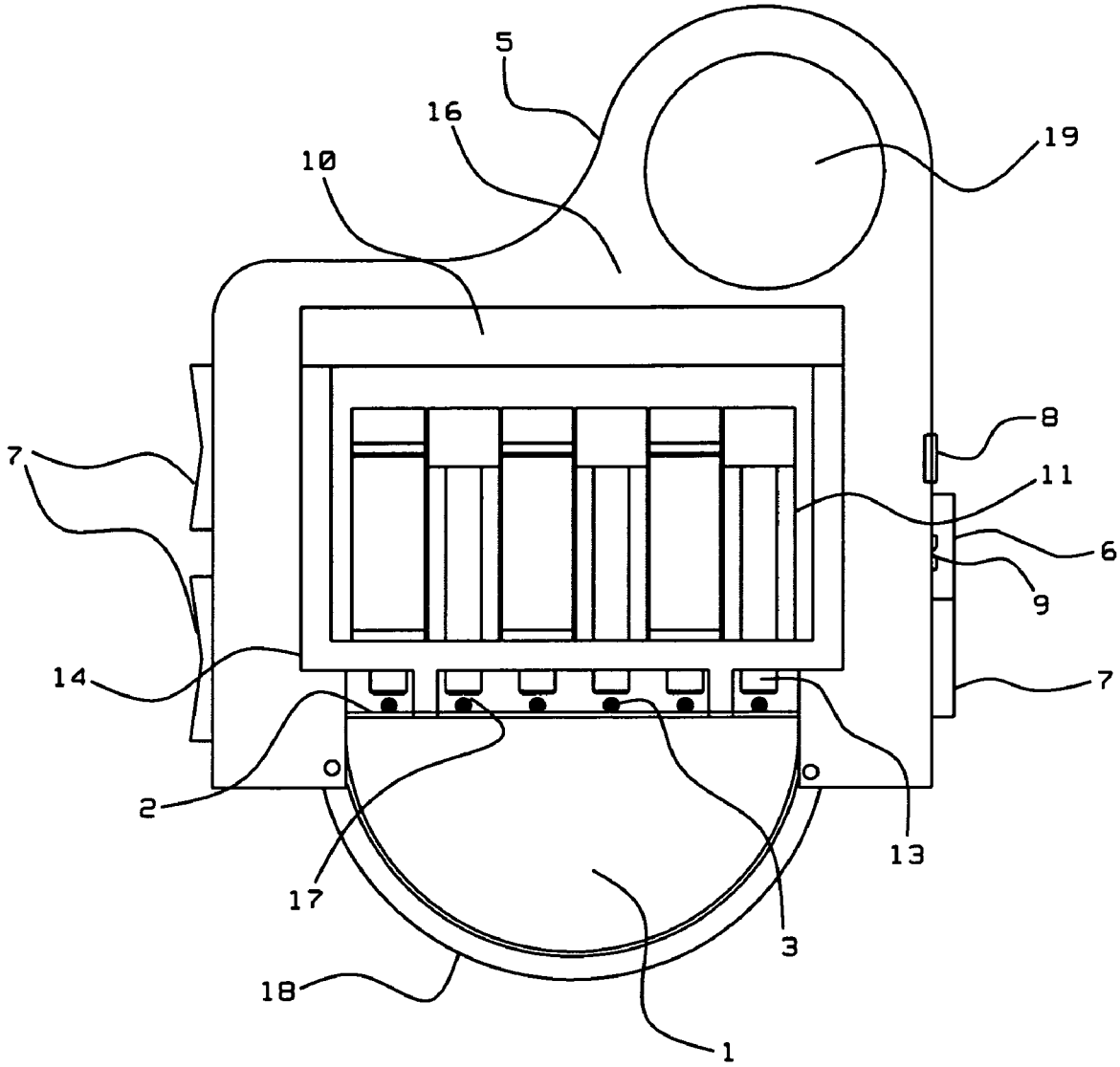
FIG. 2 is a cross section view the 'E-Z Master Chord' device according to current application mounted on an acoustic guitar.

FIG. 1 is a perspective view of an 'E-Z Master Chord' device (5) according to current application mounted on an acoustic guitar neck (1); FIG. 2 is a cross section view of the 'E-Z Master Chord' device (5) in FIG. 1; And FIG. 2 is a side view of an 'E-Z Master Chord' device, (5) FIG. 1; FIG. 4 is the opposing side to FIG. 3 of the 'E-Z Master Chord' (5) device.

The 'E-Z Master Chord' device (5) is affixed over fret portion (2) of an acoustic guitar neck (1) to generate a chord with only two fingers of a player. The 'E-Z Master Chord' device (5) is comprised of 12 key pads (7), these keypads (7) are divided into two groups: the first group is the set of keypads (shown as 7B in FIG. 3). which when depressed engage the circuitry for selecting individual musical keys; the second set of keypads (shown as 7C in FIG. 4) which when depressed engage the circuitry for selecting chord inversions, are installed on the outer shell of the E-Z Master Chord (5), two retaining straps (18) that engages the key box to the neck of the guitar (1) affixing the E-Z Master chord device (5) to the fret (2) of the guitar, an electronic circuit board (10) installed inside of the outer casing key pad box (5) just below the key pads for engaging 'major and minor chords (7A), and key pads for 'inversion, and 'four note' chords (7B shown in FIG. 1B), pluralities of electromagnetic actuators (11) installed inside of the outer casing key pad box (5) just below the circuit board (10), a metal spring (12) installed inside of the outer casing key pad box (5) just below the electromagnetic actuators (11), and pluralities of pressing pins (13) installed inside of the outer casing key pad box (5) just below the metal spring (12) and over strings (3) of the guitar neck (1), and a battery (19) installed inside of the outer casing key pad box (5).

Figure 3:
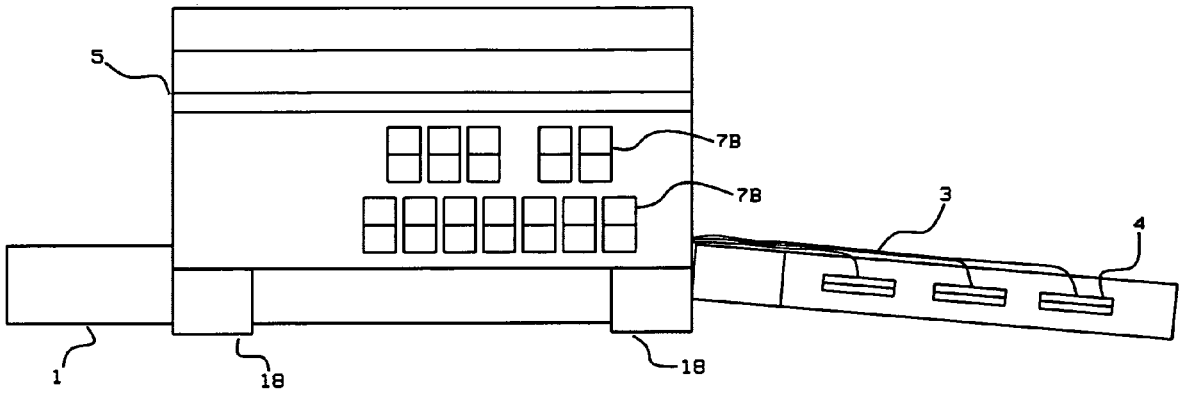
FIG. 3 is the musical key side view of the 'E-Z Master Chord' device according to current application mounted on an acoustic guitar.
Figure 4:
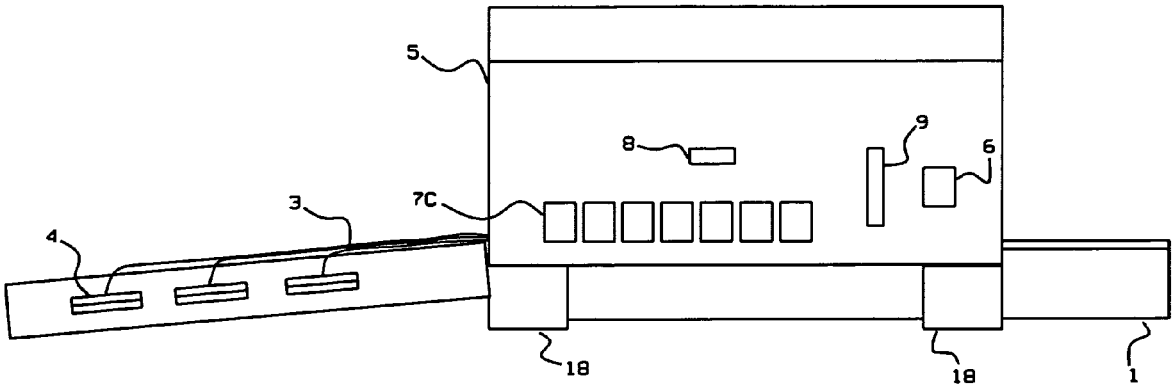
FIG. 4 is the chord inversion, transposition, and memory side view of an 'E-Z Master Chord' device according to current application mounted on an acoustic guitar.

The plurality of keypads (7) are sloped inwardly from both sides to enable a player playing two different tones of 'major' and 'minor' by pressing one side of each key pad (shown as 7B in FIG. 3) The key pads shown of are for 'inversion', and 'four note' chords (shown as 7C in FIG. 4) enable the ability for sounding '6', '7' and '9' inversion chords' combined with chords of 'Major' and 'minor' on the key pads (7) for two fingered operation to sound said inversion chords FIG. 2 is an enlarged cross section of FIG. 1 showing the pressing pin (13) connected to a electromagnetic actuator (11), connected to the logic circuit board (10) where the circuit board (10) is connected to the battery (19) and connected to the two key pads (7B FIG. 3 & 7C FIG. 4).

FIG. 3 shows the 'E-Z Master Chord' which when holding the guitar with your left hand on the neck (1) under the 'E-Z Master Chord' the players, second (index), third (middle), fourth (Ring), and fifth (Baby) fingers are available to depress the plurality of keypads (7B) either primarily, to sound a 'Major' or 'minor' chords.

FIG. 4 shows the 'E-Z Master Chord' which when holding the guitar with your left hand on the neck (1) under the 'E-Z Master Chord' the players, first finger (Thumb) are available to depress a plurality secondary keypads (7C) in conjunction with the primary Keypads (7B) shown on FIG. 3. in order to enable the ability for sounding '6', '7' and '9' 'inversion chords'. The four position switch (8) is used to activate the three different timer memory circuit components of the memory circuit (not shown), which is an ancillary function to the device for recording a series of chord progressions in time. Often the player may need to 'transpose' what the player is playing but does not have the required knowledge to do so adequately. The seven position switch (9) activates the ability to transpose chords up by three 'half step' keys or down three 'half step' key.

This function enables the player who is reading a music sheet showing that a 'C Major' chord should be played, and providing the ability to play the 'C Major' Chord, but sounding C#/Db, D, D#/Eb, B, Bb/A#, and A.

When a user of the 'E-Z Master Chord' device (5) presses a key pad (7), the logic circuit (not shown) attached to the circuit board (10) governs the voltage to the corresponding electromagnetic actuators (11). The number of electromagnetic actuators engaged is determined by the logic circuit (not shown) to engage three to six electromagnetic actuators (11) depending on the chord to play. Then, each corresponding electromagnetic actuator (11) pushes the corresponding pressing pin (13) to press the string (3).

Figure 5:
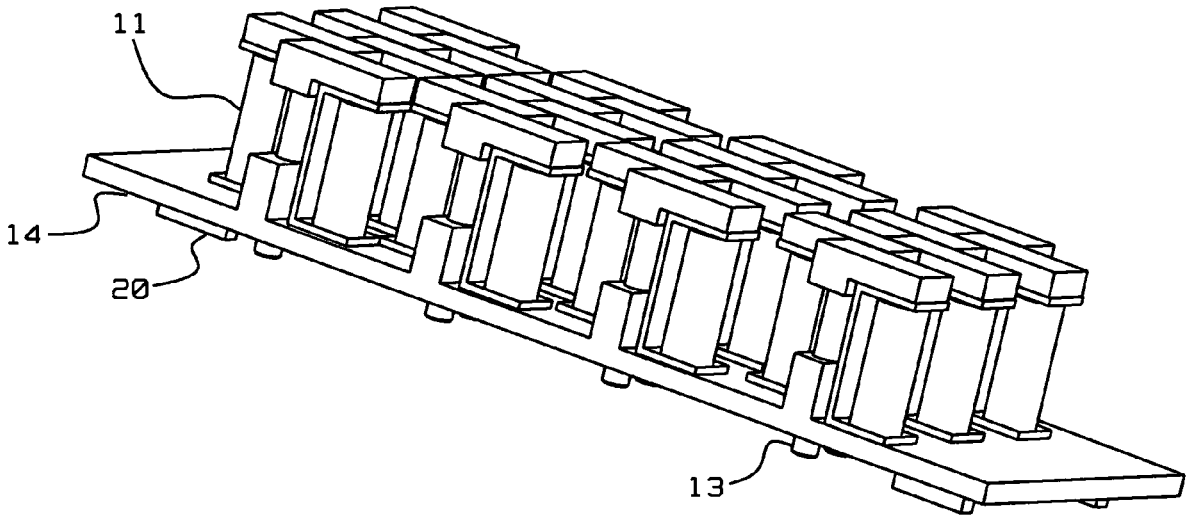
FIG. 5 is an enlarged view of the plurality of electromagnetic actuators in their arrangement mounted to the electromagnetic actuator assembly plate.

FIG. 5 is an enlarged view of the plurality of electromagnetic actuators (11) in their arrangement mounted to the electromagnetic actuator assembly plate (14) which shows the position of the pressing pins (13) which pass through holes in the assembly plate (14). This assembly plate is harnessed inside the outer housing of the E-Z Master Chord (5) as shown in FIG. 2.

Figure 6:
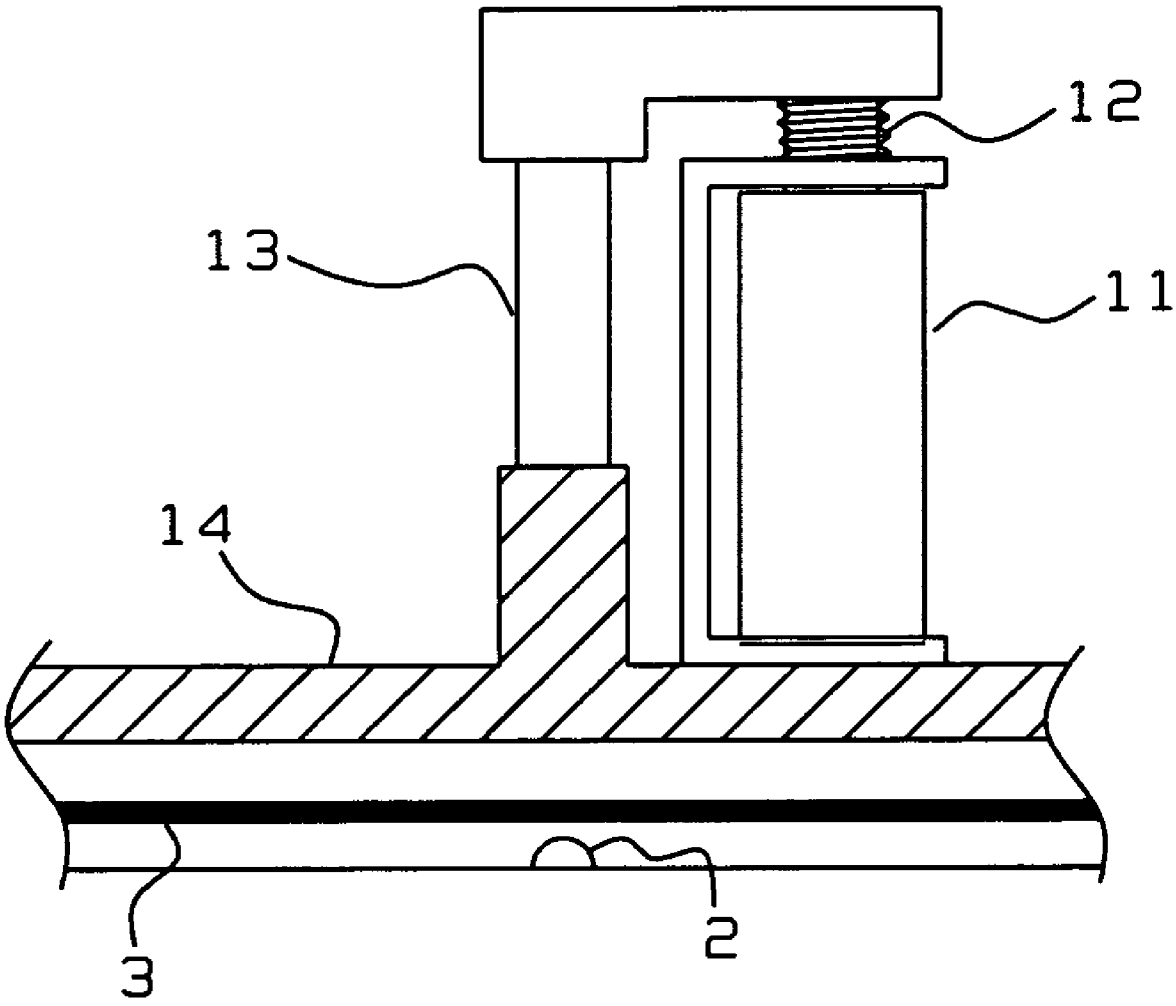
FIG. 6 is a single electromagnetic actuator demonstrating the not engaged position of the electromagnetic actuator as the 'E-Z Master Chord' is mounted on the finger board of the guitar.

FIG. 6 is an enlarged view of a single electromagnetic actuator in the not-engaged position The "not engaged" portion shows the space between the fret (2) with the string (3), and the space between the string (3) and assembly plate (14), not showing the contact (17), which is resting inside the hole in the not engaged position.

Figure 7:
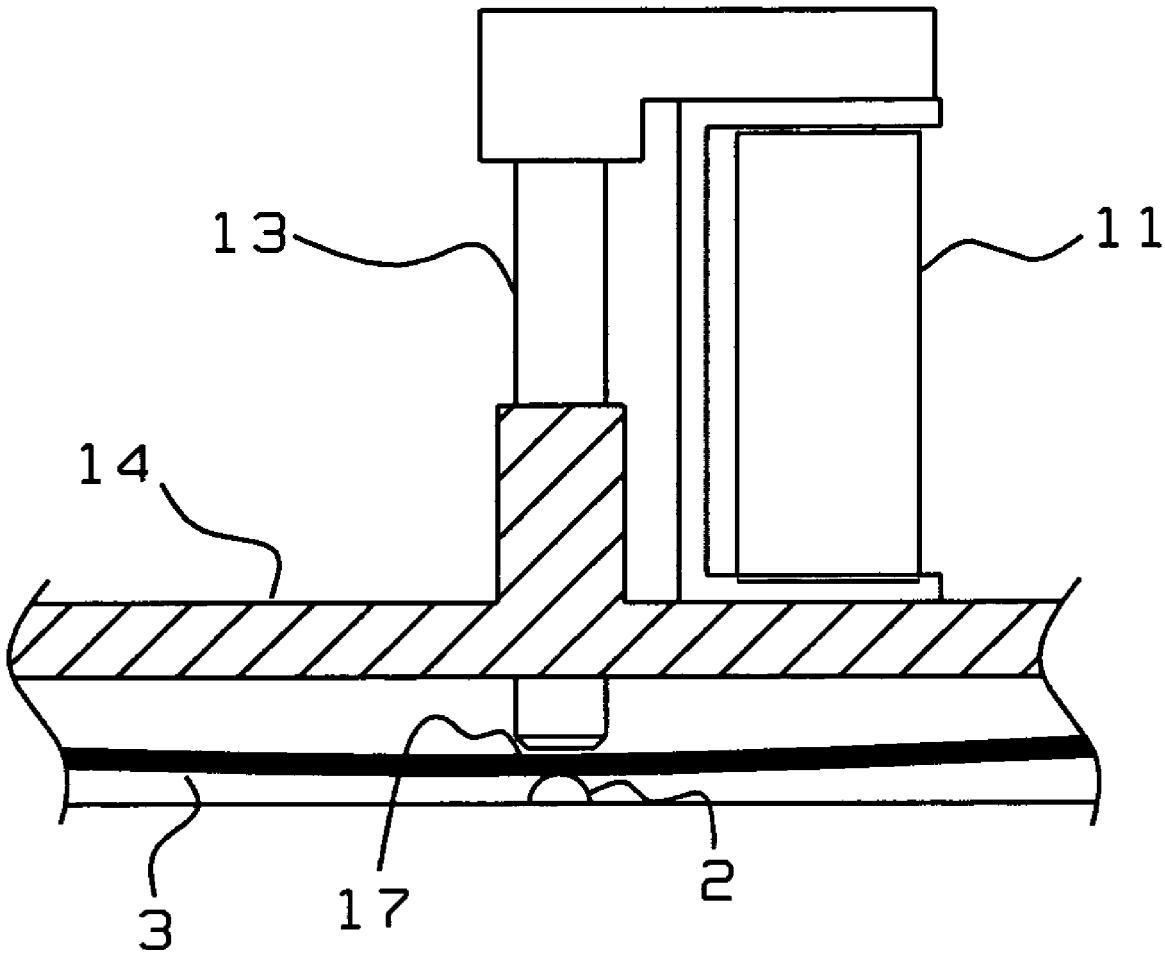
FIG. 7 is a single electromagnetic actuator demonstrating the engaged position of the electromagnetic actuator as the 'E-Z Master Chord' is mounted on the finger board of the guitar.

FIG. 7 is an enlarged view of a single electromagnetic actuator (11) in the engaged position. The "engaged" portion shows the contact (17) of the pressing pin (13) to the string (3) to the fret (2). The metal spring (12) used to disengage the pressing pin (13) attached to the assembly plate (14), in the electromagnetic actuators (11).

Figure 8:
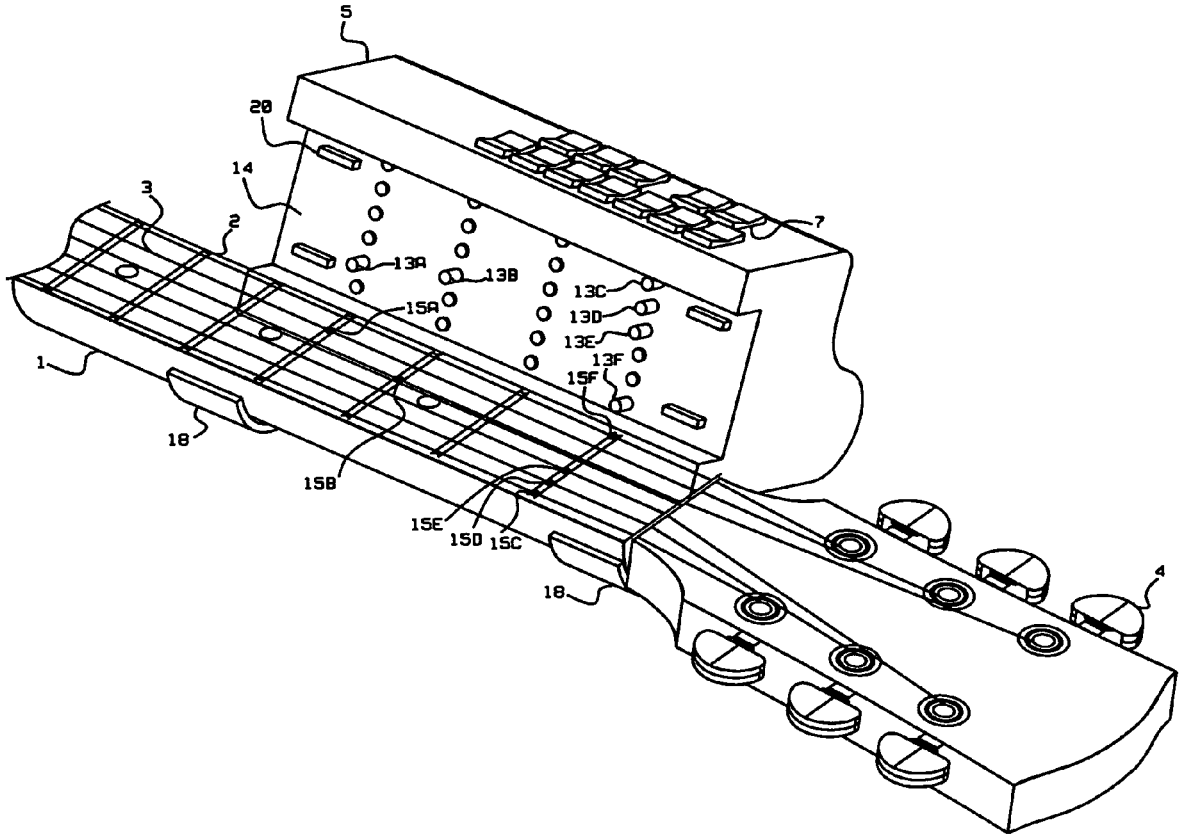
FIG. 8 is a schematic drawing of the 'E-Z Master Chord' device in open position to show pressing pins and the corresponding pressing points, the figure demonstrates the pressing pins which engage to play a "C#-Db Major 7" chord.

FIG. 8 is a schematic drawing of the 'E-Z Master Chord' device (1) in open position to show pressing pins (13). Since it is the purpose of the current application to make it easy to play most of the chords, every possible chord should be playable without changing the position of the device. Therefore, number of pressing pins (13) needed is equivalent to the number of finger positions shown as contact points (15) on the guitar neck (1), which is directly place on the fret (2) where a player's finger would be placed, for every chord.

Twenty four pressing pins (13) are needed for contact points over six strings (3) which is equivalent to four electromagnetic actuators (11) per each string (3) placed directly over the four frets (2) that the device (5) is located over when attached to the neck (1) of the guitar. There are six pressing pins (13) engaged noted as 13A through 13F, which correspond to the contact point (15) of the string (3) above the fret (2). The contact points (15) are noted as 15A through 15F. The logic circuit (not shown) attached to the circuit board (10) is predetermined to engage the appropriate electromagnetic actuators (11) attached to a pressing pin (13) when a key pad (7), or key pads (one of key pad of the group in 7A with one key pad of the group in 7B) is pressed. There are 168 different combinations of pre programmed engagements of electromagnetic actuators.

An example of engaged pressing pins (13) to play "C Major 7" chord shown facing towards the top of the page of the FIG. 3, is guitar neck (1) of an acoustic guitar. The dark circles show pressing points (15A), (15B) (15C) (15D) (15E) and (15F), on the guitar neck (1) which indicate the finger points (15) to be pressed by a player's finger to play "C Major 7". Shown facing the left edge of the page of FIG. 3, is the inside view of the electromagnetic actuator assembly plate (14). Six pins (13A), (13B), (13C), (13D), (13E), and (13F), are protruded from the metal spring (12) to press the corresponding pressing points (15A), (15B), (15C), (15D), (15E), and (15F) onto the fret (2).

As it is demonstrated in FIG. 8 above, we know it is not easy even for an expert player to press six points at the same time; however, the 'E-Z Master Chord' device (5) of the current application enables press six points at the same time by pressing one or two key pads.

Although the invention has been described with reference to certain specific embodiments thereof, it is to be distinctly understood that various modifications and adaptations of the arraignments herein disclosed may made as may readily occur to persons skilled in the art without constituting a departure from the spirit and scope of the invention as defined in the objects and in the appended claims.

What is claimed is:

1. An aiding device for a fretted stringed musical instrument having a neck with frets spaced longitudinally thereon and strings spaced laterally there across said neck for positioning said strings at different fret positions, wherein the aiding device is engaged over frets of an acoustic guitar to generate a chord with only two fingers of a player, comprising a molded housing which encloses twelve two position key pads installed on the key pad box, and seven single position key pads installed on the molded housing, and a strap harness that engages the molded housing to fret portion of a guitar, and an electronic circuit board installed inside said housing, and a plurality of electromagnetic actuators installed inside of the said housing just below the circuit board, and a metal spring installed inside of the key pad box just atop the electromagnetic actuators, and a plurality of pressing pins installed inside said housing just below the metal spring and over strings of the guitar, and, a rechargeable battery installed inside said housing, and each key in the set of twelve keys can play two kinds of chord for creating 'major' and 'minor' sonorities, and each key in the set of seven keys has a specific function to add one or two extra tones for chord 'inversions', '7', '9', 'augmented', and 'diminished' sonorities; and, a four position switch electrically coupled to a timer memory circuit installed inside said housing on said circuit board, and a seven position switch for setting a fixed transposition is electrically coupled to said logic circuit installed inside said housing attached to said circuit board; where, the device is longitudinally attachable to said neck with compressible retaining straps affixed to the molded frame itself thereby affixing the device with mechanical pressure to the elongated section of said neck; where, the feet of the electromagnetic actuator assembly board rest atop the face of said neck thereby creating a gap for said strings to vibrate openly above the fret and below a plurality of electromagnetic actuators connected to the corresponding pressing pins; where, the pressing pins extend transversely across the stringed face of said neck pressing said string against said fret according to the combination of said keys pads pressed, triggering said logic circuit to engage the appropriate electromagnetic actuator thus permitting said pressing pins to be pressed toward said strings thereby pinching said string against said fret in the various combinations programmed in the logic circuit; where, the circuit board positioned within said housing, said logic circuit enables a trigger circuit which directly and electrically coupled to the electromagnetic actuator thereto, wherein said electromagnetic actuator is engaged until the logic circuit is interrupted by the manual releasing of said key pad, which then triggers a reset command signal to said trigger circuit which then disengages said electromagnetic actuator.

2. The timer memory circuit according to claim 1 enables the user to program three different chord progressions recorded in time.

3. The transposition switch according to claim 1 enables the player to select a fixed, one, two, or three 'half step' offset higher or lower than the player selected key pad function in the logic circuit, thereby creating an immediate transposition of the key relationship of the manually selected key.

* * * * *